United States Patent [19]

Gilbert

[11] 4,426,984

[45] Jan. 24, 1984

[54] APPARATUS FOR ENTRAINING GASOLINE IN AIR FOR USE IN AN INTERNAL COMBUSTION ENGINE

[76] Inventor: Jack J. Gilbert, 3 River Rd., Suffern, N.Y. 10901

[21] Appl. No.: 296,659

[22] Filed: Aug. 27, 1981

Related U.S. Application Data

[63] Continuation-in-part of Ser. No. 112,242, Jan. 14, 1980, abandoned.

[51] Int. Cl.[3] ..... F02M 21/04

[52] U.S. Cl. ..... 123/522; 48/144; 48/180 C; 261/46; 261/121 R; 261/124; 123/535

[58] Field of Search ..... 48/144, 219, 180 A, 48/180 C, 180 P, 160; 123/535, 522; 261/DIG. 83, 124, 46, 121 R

[56] References Cited

U.S. PATENT DOCUMENTS

| | | | |
|---|---|---|---|
| 349,211 | 9/1886 | Cottrell | 48/219 |
| 527,639 | 10/1894 | Westcott | 261/124 |
| 1,598,243 | 8/1926 | Chapin | 48/180 A |
| 1,883,142 | 10/1932 | Wannack | 48/219 |
| 1,889,162 | 11/1932 | Thomas et al. | 48/180 C |
| 2,565,767 | 8/1951 | Gaskell | 123/522 |
| 3,338,223 | 8/1967 | Williams | 123/522 |
| 3,986,846 | 10/1976 | Bivins | 48/180 C |
| 4,271,098 | 6/1981 | Henning et al. | 261/66 |

OTHER PUBLICATIONS

Kirk-Othmer, 2nd Ed., Encyclopedia of Chem. Tech., vol. 6, pp. 271, 272. 1968.

Kirk-Othmer, 3rd Ed., Encyclopedia of Chem. Tech., vol. 7, p. 104, 1979.

Thorpe's Dictionary of Applied Chemistry, 4th Ed., vol. 8, p. 474, 1947.

*Primary Examiner*—Peter F. Kratz

*Attorney, Agent, or Firm*—Leo C. Krazinski

[57] ABSTRACT

A generator for converting volatile combustible liquids, such as gasoline, methanol and the like, into an aeriform gas including a closed vessel containing liquid gasoline maintained at a predetermined level, evaporating the liquid gasoline by passing streams of desiccated atmospheric air therethrough, after which the resulting gas is passed through specially processed charcoal material, which stabilizes the resulting gas into an aeriform gas as a fuel source for internal combustion engines.

7 Claims, 12 Drawing Figures

AIR
LOW VOLUME CONTROL
TO INTAKE MANIFOLD
HIGH VOLUME CONTROL
AIR

APPARATUS FOR ENTRAINING GASOLINE IN AIR FOR USE IN AN INTERNAL COMBUSTION ENGINE

This application is a continuation-in-part Application of United States patent application, Ser. No. 112,242 filed Jan. 14, 1980 now abandoned.

BACKGROUND OF THE INVENTION

1. Field of the Invention

The present invention relates to gasification of liquid petroleum and, more particularly, to conversion of volatile combustible liquids into an aeriform fluid, that is, gas.

2. Description of Prior Art

Prior to the subject invention, as far as applicant is aware from a search of the Patent Office records, gasification of a volatile combustible liquid into an aeriform gas as a fuel source has not been taught. U.S. Pat. No. 2,351,072 discloses a method of producing vaporous mixtures of air and a liquid in a finely divided state. U.S. Pat. No. 4,149,853 discloses means for improving the efficiency of fossil fuel combustion equipment by introducing organic reactive intermediates to the air-fuel mixture prior to ignition.

SUMMARY OF THE INVENTION

Accordingly, it is a primary object of the present invention to provide a new and improved method and associated apparatus for gasifying volatile combustible liquid into an aeriform fluid, thereby substantially increasing the efficiency of the combustible liquid for fuel purposes.

Another object of the invention is to provide a simple, low cost and efficient method and apparatus for converting gasoline into an aeriform gas as fuel for internal combustion engines.

Still another object of the invention is to improve the quality of fuel for use in internal combustion engines.

Yet another object of the invention is to accomplish the foregoing objects in a simple, practical and economical manner.

DESCRIPTION OF PREFERRED EMBODIMENT

In accordance with a preferred embodiment of the present invention, the foregoing objects are accomplished by providing a method and apparatus for improving substantially the efficiency of liquid petroleum for use as a fuel in internal combustion engines. The liquid petroleum, such as gasoline, is transferred from a fuel tank to a closed container having a vaporizing cell therein and the gasoline is held at a fluid reservoir level of about 50% of the total volume of the container by a combination of electrically operated solenoid valve and photo optic switch in order to maintain an internal pressure barrier between the upper level of the container and the upper level of liquid gasoline. Atmospheric air is first passed through a filter containing a desiccant to remove any moisture and is then introduced into the container in such a manner as to diffuse the demoisturized air through the gasoline and thereby expand the volatile liquid within the confined area of the container. This creates a rapid but partial evaporation thereof and returns the liquid vapor down to the reservoir level while the evaporated gases rise to the upper portion of the container and are drawn through a solid porous structure of about 120 microns, mounted at the top of the vaporizing cell, created by a vacuum cycle in the engine. The evaporated gases are broken into finer particles and pass through another porous structure of about 90 microns and then through a chemically treated activated charcoal cartridge. Upon entrance into the cartridge the gases are relatively aeriform and in passing through the cartridge stabilization takes place, after which the stabilized aeriform gas passes through a small tube into the intake manifold of the engine.

BRIEF DESCRIPTION OF THE DRAWINGS

Preferred embodiments of the invention have been chosen for purposes of illustration and description and are shown in the accompanying drawings, FIGS. 1 to 3 showing one embodiment and FIGS. 4–11 showing an improved embodiment, wherein.

Figure 1:
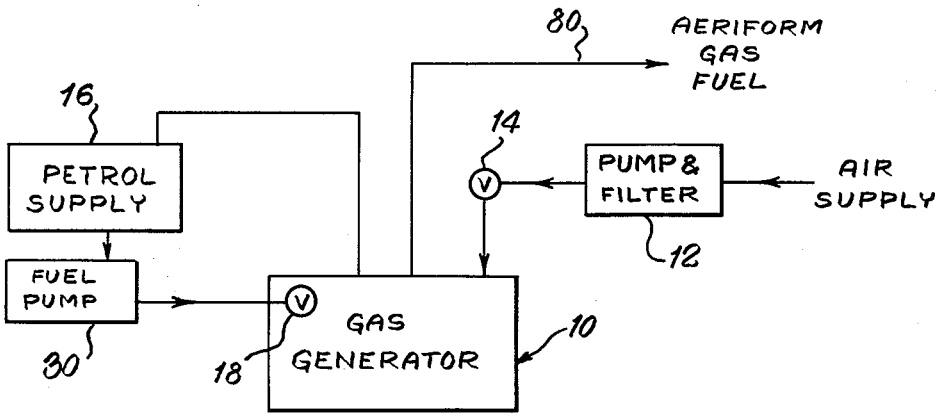
FIG. 1 is a block diagram of the gasification unit.

Referring now to the drawings in detail, particularly FIG. 1, there is shown in block form an aeriform gas generator 10 adapted to receive atmospheric air by a pump-filter 12 and needle valve 14, as shown at the right side of FIG. 1, and a petrol or gasoline supply 16 supplied through a valve 18, as shown at the left side of FIG. 1, after which the aeriform gas fuel is exited, as shown at the top of FIG. 1.

Figure 2:
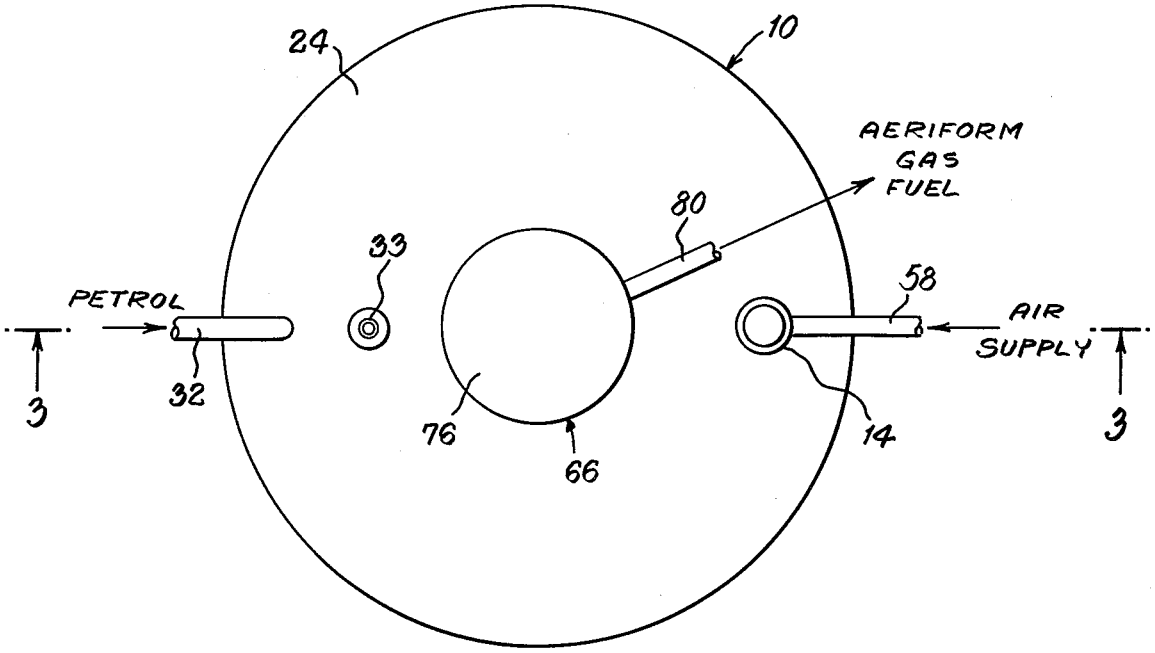
FIG. 2 is a top plan view of the unit.
Figure 3:
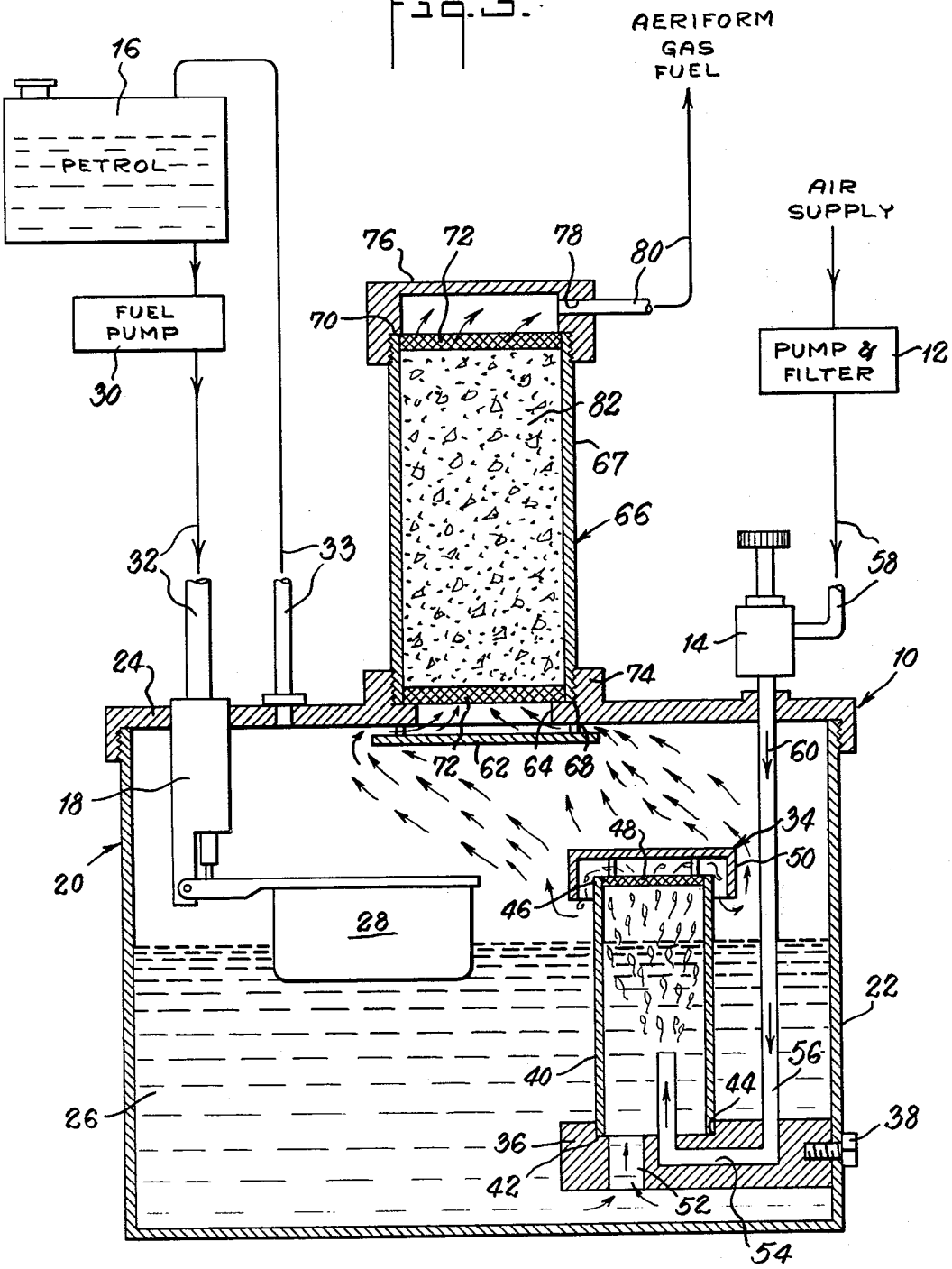
FIG. 3 is a sectional view taken along line 3—3 of FIG. 2.

In FIGS. 2 and 3 are shown in detail the gas generator 10 which includes a circular receptacle or container 20 having a main body 22 with a removable cover 24, preferably threadedly mounted for ready access, to provide a sealed container for maintenance of internal pressure in the generation of aeriform gas. Within the container 20 is shown a liquid gasoline reservoir 26 that is held to a predetermined level of 50 percent, plus or minus 5 percent, of the volume of the interior of the container 20, the valve 18, and a float 28 for maintaining said gasoline level. The gasoline is fed to the container 20 by gravity or by a fuel pump 30 through a tube 32 from the petrol supply 16. A tube 33 interconnects the container 20 and gasoline supply 16 for equalizing the pressures therein. Also within the container 20 is disposed an evaporator 34 for converting the liquid gasoline into a gas by passing air through the liquid gasoline. The evaporator 34 includes a round base 36 fastened to a side wall of the body 22 of the container 20 by a stud 38 above the bottom of the body 22, a hollow open ended cylinder 40 having its lower end hermetically sealed in an upper recess 44 of the base 36 and its upper end 46 provided with a screen 48 of 200 mesh stainless steel. An inverted "U" shaped baffle 50 is also mounted at the upper end 46 of the cylinder 40 a short distance above the screen 48 to provide a space therebetween. The base 36 is shown with a vertical, through opening 52 for passage of liquid gasoline into the interior of the evaporator cylinder 40 and a "U" shaped opening 54 for disposition therein of an air input tube 56 that extends from the interior of the cylinder 40, thence out of the base 36, alongside an inner wall of the container body 22, and out of the container 20 through the needle valve 14 and finally by a tube 58 to the filter-pump 12, which delivers air at a pressure of about 2–3 pounds per square inch to the interior of the evaporator cylinder 40.

Above the evaporator 34 and within the container 20 is shown a baffle 62 mounted to the underside wall of the cover 24 just below, as seen in FIG. 3, an opening 64 extending through the cover 24 for ensuring passage of gas into a charcoal vessel 66, liquid gasoline being baffled and dropped to the gasoline reservoir 26, as will be brought out hereinafter. The charcoal vessel 66 comprises an open ended cylinder 67 having at its lower and upper ends, 68 and 70, respectively, a stainless steel screen 72 of 200 mesh. The lower end 68 of the cylinder 67 is threaded for mesh engagement with a threaded upstanding boss 74 provided on the cover 24 and the upper end 70 of the cylinder 67 is also threaded for mesh engagement with a "U" shaped cap 76 which has an opening 78 through a sidewall for connection of a tube 80 for discharge of the aeriform gas to an energy consuming device (not shown), such as an internal combustion engine or furnace.

Within the cylinder 67 is shown activated charcoal 82 that is sandwiched between the lower and upper screens 72 to prevent charcoal particles from dropping into the reservoir 26 or passing outward into the tube 80. The chemical formula for activating the charcoal is as follows:

(a) Wood or bone charcoal of six to eight mesh, quantity to be determined by the amount of gas to be processed at the rate of cubic feet per minute.

(b) Cupric Chloride $CuCl_2 2H_2$) crystals prepared in a solution of distilled water with the ratio 50 ml. of water to 8 gram of Cupric Chloride and dissolved.

(c) Place charcoal granules into an open vessel and pour in dissolved solution onto the charcoal. Permit the saturation to take place for approximately 10 minutes.

(d) Remove the saturated charcoal material and spin dry for approximately five minutes by use of centrifuge or alternative method using a kiln with a controlled temperature of 100° C. for approximately 25 to 30 minutes.

(e) Place the activated material in a sealed container to prevent any moisture accumulation until ready for use.

In operation, liquid gasoline flows from the supply 16 via fuel pump 30, tube 32 and check valve 18 to the container 20 until the gasoline reaches a predetermined level in the reservoir 26 which level is maintained by the valve 18 and float 28 at about 50% of the total volume of the container 20. This is required in order to maintain an internal pressure barrier between the upper level of the container 20 and the upper level of the liquid gasoline. The same level of liquid gasoline obtains in the evaporator 34 by the gasoline entering the interior of the container 40 via opening 52. Atmospheric air is introduced in the interior of the evaporator 34 via pump-filter 12, tube 58, needle valve 14 and tube 56, the pressure and amount of air being governed by the needle valve 14. It has been found that an air pressure of about 2–3 P.S.I. is satisfactory. As is indicated by the arrows within the evaporator cylinder 40 and container 20, the incoming air 60 expands the volatile liquid gasoline within the confined upper area of the cylinder 40 so that there is a rapid but partial evaporation thereof with some liquid gasoline striking the baffle 50 and returning it to the reservoir 26 while the aeriform gas continues in a serpentine manner via screen 48, baffle 50, upper area of container 20, baffle 62 and thence into the chemically treated activated charcoal vessel 66, entering through lower screen 72 passing through charcoal 82 where the gas is stabilized, thence through upper screen 72, cap 76, opening 78, and tube 80 as an aeriform gas to be utilized especially as fuel in internal combustion engines. It has been found that this first embodiment of the invention increases the efficiency of gasoline in the operation of internal combustion engines by at least a ratio of 2 to 1, which is substantial in view of the prevailing high cost of gasoline.

In the above first embodiment it has been found by testing a prototype thereof that moisture in the incoming atmospheric air passing through the pump filter 12 and thence through the volatile combustible liquid in cylinder 40 contaminated the combustible liquid to such an extent that the combustible liquid lost its volatility and thereby failed to operate internal combustion engine. Accordingly, in the next embodiment of the invention the moisture is substantially eliminated from the incoming atmospheric air and other improvements provided.

Referring now to FIGS. 4 to 10, there is shown an improved gas generator 83 which includes an arcuate receptacle or container 84 having a main body 86 with a removable cover 87, threadedly mounted by bolts 88 for ready access, to provide a sealed container for maintenance of internal pressure in the generation of aeriform gas. At the outset it might be mentioned that the gas generator of this invention may be considered as equivalent to the functioning of a carburetor in an internal combustion engine of a motor vehicle. Within the container 84 is shown a reservoir 89 for holding liquid gasoline 90 that is held to a predetermined level of fifty percent (50%), plus or minus five percent (5%), of the volume of the interior of the container 84. It is important that this level be maintained, as it was found that the conventional valve 18 and float 28 of the prior embodiment of this invention did not operate efficiently or effectively in the negative pressure environment of reservoir 26 (FIG. 3), particularly because the vacuum in the reservoir 26 has a tendency to override the float 28 in view of the positive pressure created by the fuel pump 30.

Figures 4, 9:
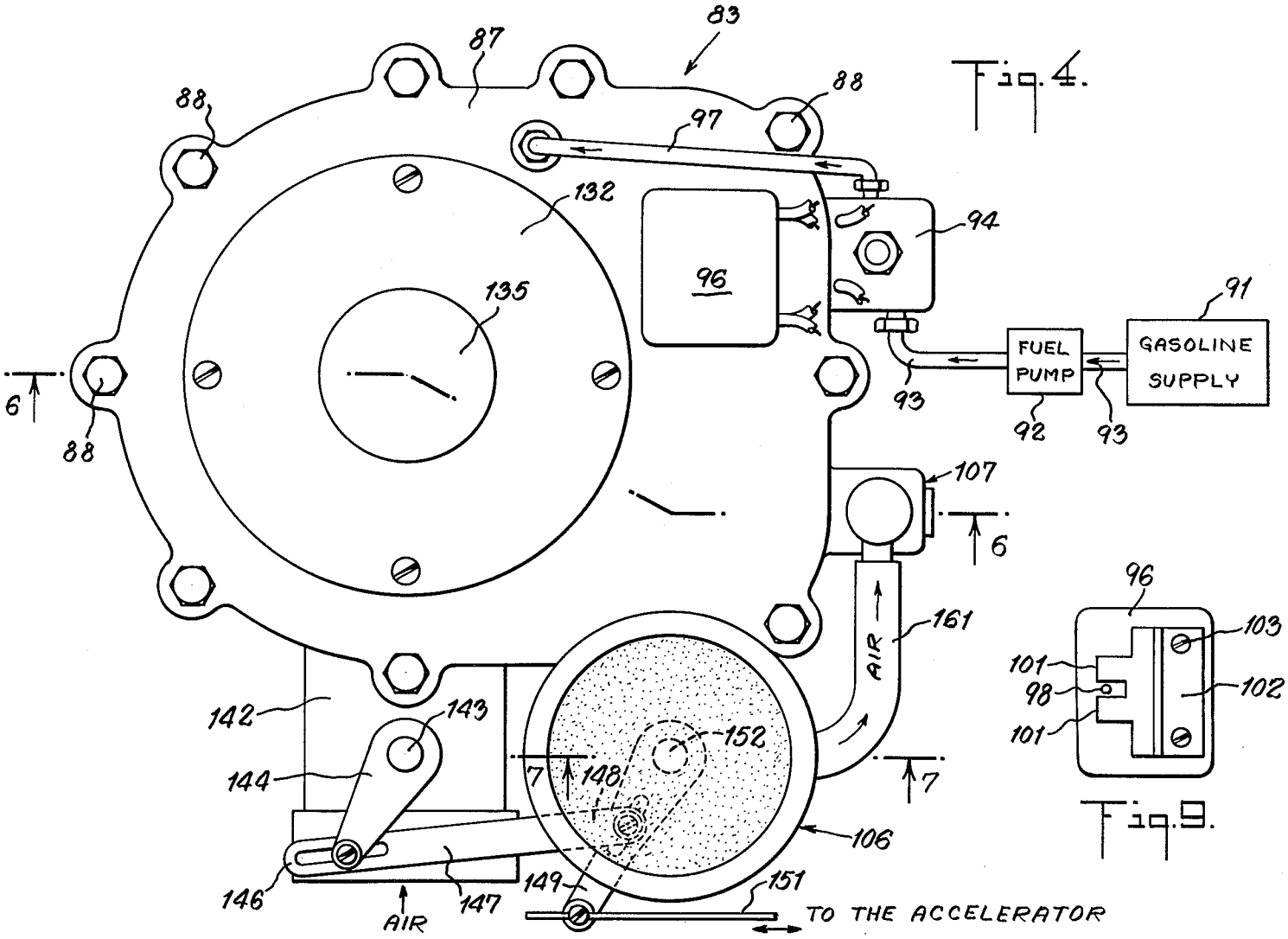
FIG. 4 is a top plan view of an improved gasification unit.
FIG. 9 is a top plan view of the photo optic sensor switch.

Accordingly, in this improved embodiment gasoline 90 is shown fed from a supply tank 91 by a fuel pump 92 through a tube 93 into and through a port of an electrically operated solenoid valve 94 that is controlled by a photo optic switch 96 (FIGS. 6 & 10), the functioning of which will be described hereinafter with respect to FIG. 12. The gasoline 90 exits from the solenoid valve 94 and flows via tube 97 (FIG. 4) through the cover 87 and thence into the reservoir 89. The photo optic switch 96 includes a small rod 98, about one sixteenth of an inch in diameter, having at its lower end (FIG. 10) a hollow ball 99 that is freely floatable on the gasoline in the reservoir 89 and having its upper end disposed between opposing faces 101 of the optic switch 96 (FIG. 9). The optic switch 96 is carried by a bracket 102 fastened to the cover 87 by screws 103 and the rod 98 passes freely through an opening 104 in the cover 87. It is thus seen that the photo optic sensing switch 96 becomes a positive means for maintaining the required fifty percent (50%) level at all the phases of normal operation of an internal combustion engine.

Figures 6, 10:
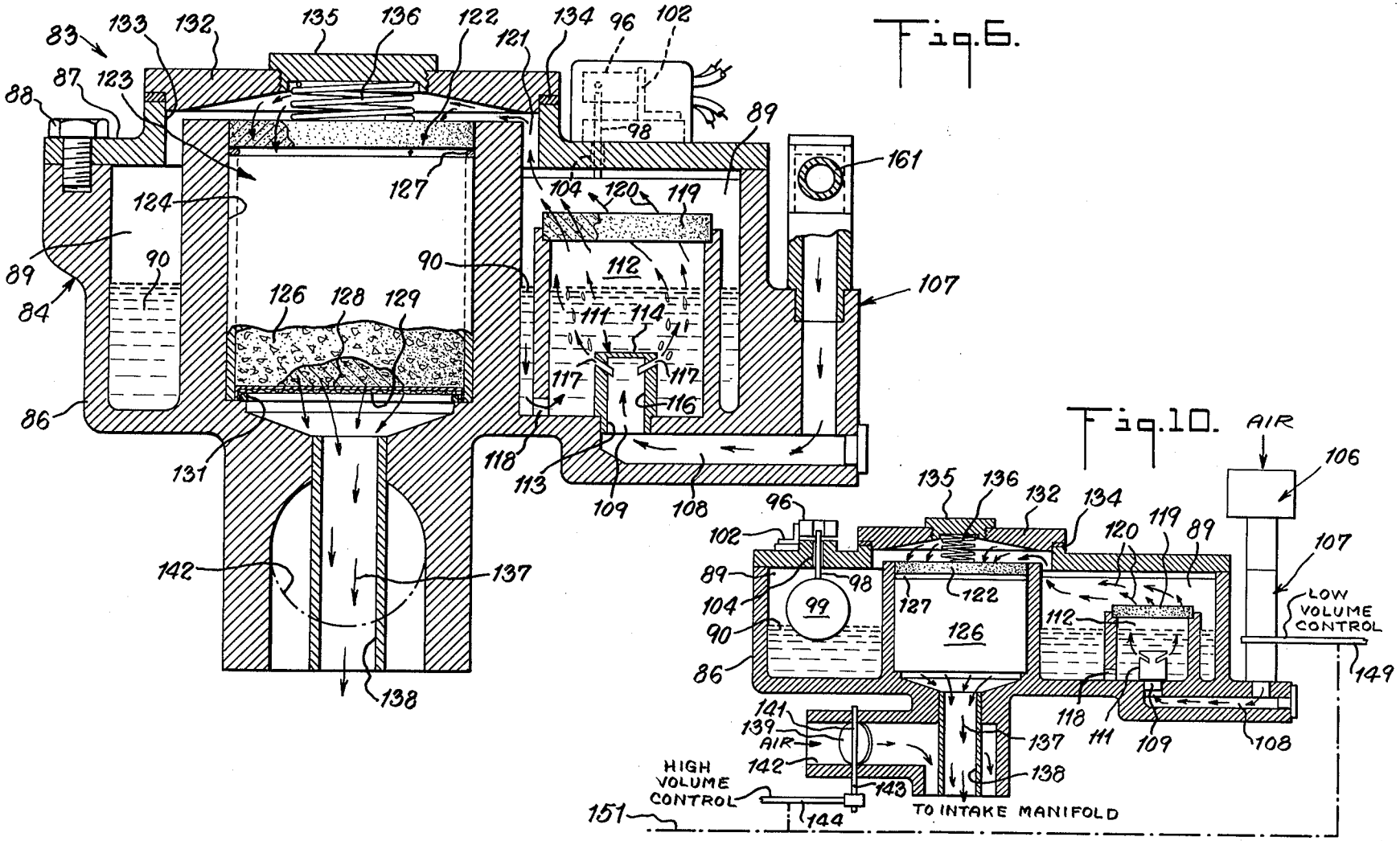
FIG. 6 is a sectional view taken along lines 6—6 of FIGS. 4 and 5 in the direction of the arrows.
FIG. 10 is a sectional view showing paths of air and gasoline through the unit.

As stated hereinbefore, the incoming atmospheric air must be demoisturized. This is done by providing a desiccant filter 106 which has a sufficient amount of silica gel (crystal or alike) of about 8–16 mesh. It is again stated that the incoming air must be free of moisture, as otherwise the fluid will be contaminated with the moisture to such an extent that the liquid loses its volatility and renders the engine inoperative. The demoisturized air passes from the filter 106 downward, as seen in FIGS. 6 and 10, through a tubular arrangement 107, thence along a horizontal passageway 108 in the main body 86 and upwardly through an opening 109 in the body 86 into an evaporator 111 disposed within a vaporizing cell 112 for converting the liquid gasoline 90 into a gas. The evaporator 111 acts as a nozzle having its lower portion 113 forming the opening 109, its upper portion 114 closed, and in its side wall 116 having upwardly inclined slits 117 for jetting the incoming demoisturized air into the vaporizing cell 112, as indicated by the arrows. The vaporizing cell 112 is preferably an integral part of the main body 86 disposed within the reservoir 89 having an opening 118 in its lower left portion, as viewed in FIGS. 6 and 10, for passage of the liquid gasoline 90 into the interior of the vaporizing cell 112 where the liquid gasoline surrounding the evaporator slits 117 is expanded rapidly into gaseous form. The vaporizing cell 112 has a cover 119 which is a disc made of solid porous material of about 120 micron and the expanded rising gas 120 is drawn through the cover 119 under a vacuum cycle created by the internal combustion engine (not shown). At this point the liquid gasoline 90 is dropped into the reservoir 89 and the expanded gas 120 is broken down into finer particles and are drawn via an opening 121 in the main body 86 into and through a second solid porous disc 122 of about 90 microns. The disc 122 is disposed upon the top of an activated charcoal vessel 123, which comprises an open ended cylinder 124 formed within the main body 86 and filled with activated charcoal 126, which is restricted within the cylinder 124 by an "O" ring 127 at the top and at the bottom by three elements, namely, a stryfoam sheet 128 contiguous to and supporting the charcoal, an ordinary window screen sheet 129 with flanged ends within which a ring 131 secures the three elements in place. The "O" ring 127 prevents moisture from entering into the cylinder and the three elements prevent particles of charcoal from dropping down from the cylinder 124. The chemical formula for activating the charcoal 126 is substantially that used in the first embodiment herein with that of nickel chloride $NiCL_2 . 6H_2O$ crystals, as an alternative equivalent of the Cupric Chloride chemical. For ready access to the charcoal vessel 123 a plug 132 is press fit into an opening 133 in the cover 87 and a gasket 134 for sealing the plug 132 to the cover 87 is disposed between the plug and cover. The plug 132 is further provided with a screw type cover 135 centrally of the plug 132 and between the underside of this cover 135 and the disc 122 is provided a spring 136 for urging the disc 122 against the charcoal 126.

Referring again to the 90 micron disc 122, the gas passing through this disc 122 is substantially aeriform and upon entering the activated charcoal 126 a stabilized reaction takes place and the newly constituted aeriform gas 137 then flows through a tube 138 into an intake manifold (not shown) of the engine (not shown). It is believed that the stabilized reaction of the gas and activated charcoal stabilizes the aeriform gas 137 and prevents it from condensing back to liquid when it enters the intake manifold.

Figure 7:
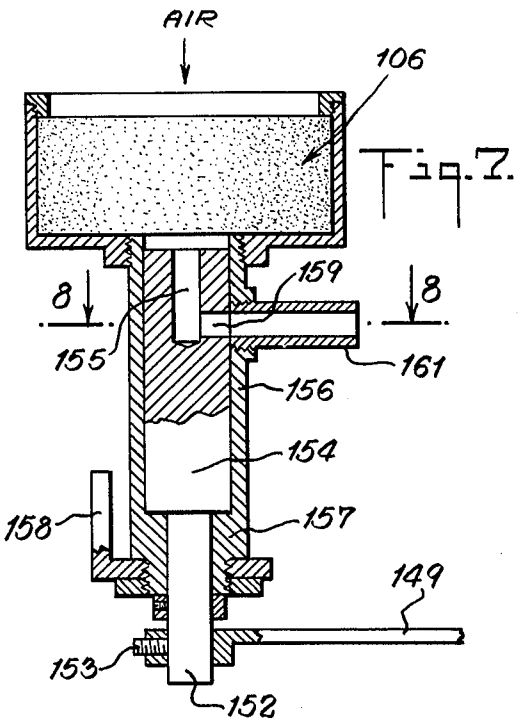
FIG. 7 is a vertical sectional view taken along lines 7—7 of FIG. 4 in the direction of the arrows.
Figure 8:
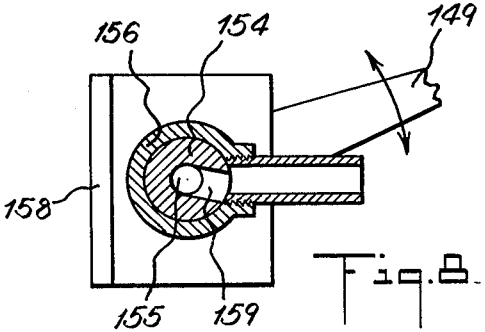
FIG. 8 is a horizontal sectional view taken along lines 8—8 of FIG. 7 in the direction of the arrows.
Figure 5:
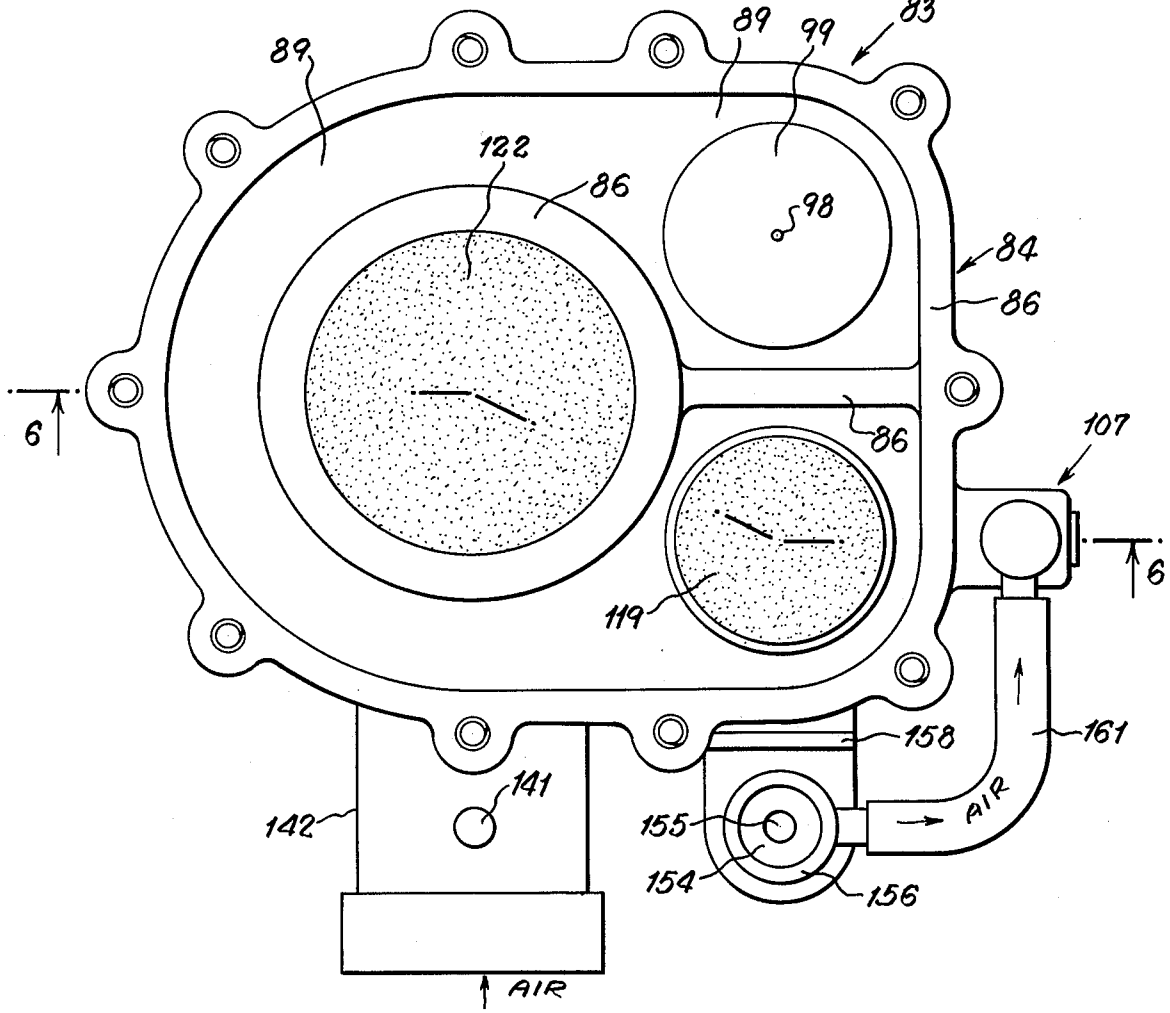
FIG. 5 is a top plan view similar to FIG. 4 with the cover removed.

Referring particularly to FIGS. 4, 7, 8 and 10, there is shown an engine butterfly valve 139 that is rigidly secured to and rotatable with a shaft 141 rotatably mounted in an engine air intake tube 142. The butterfly valve 139 is opened manually to permit normally filtered air to mix with the aeriform gas 137 at an optimal ratio of about 20 to 1. The shaft 141 has an extension 143 which is rigidly secured to a high volume air control arm 144 (FIG. 4), the end of which is pivotally connected to one end 146 of a link 147 while the other end 148 of the link 147 is pivotally connected to a low volume air control arm 149, at an intermediate point, as seen in FIG. 4. The outer end of the arm 149 is connected to a link 151 that leads to the accelerator (not shown) of the vehicle, while the inner end of the arm 149 is rigidly secured to a shaft 152 by a set screw 153 (FIG. 7). Still referring to FIG. 7, it is seen that the shaft 152 is an extension of a larger diameter shaft 154 and that both shafts are rotatable in a hollow member 156 that includes adjacent its lower end an enlarged portion 157 that is connected to and supported by a bracket 158 attached to the main body 86. The member 156 at its upper end carries the filter 106, which is threadedly connected thereto. The shaft 154 at its upper end includes a vertical passageway 155, as seen in FIG. 7, for the incoming air from the filter 106 and a connecting horizontal passageway 159 that in turn connects to a hose 161 that is attached to the hollow member 156 at one end and to the tubal arrangement 107 at its other end for entrance to the evaporator 111. The amount of registration between the horizontal passageway 159 and the hose 161 is dependent upon the position of the low volume air control arm 149 and in turn upon the position of the link 151 that responds to the position of the accelerator. Thus it is seen that the rotatable movement of the shaft 154 within the member 156 determines the amount of incoming air reaching the evaporator 111.

Figure 11:
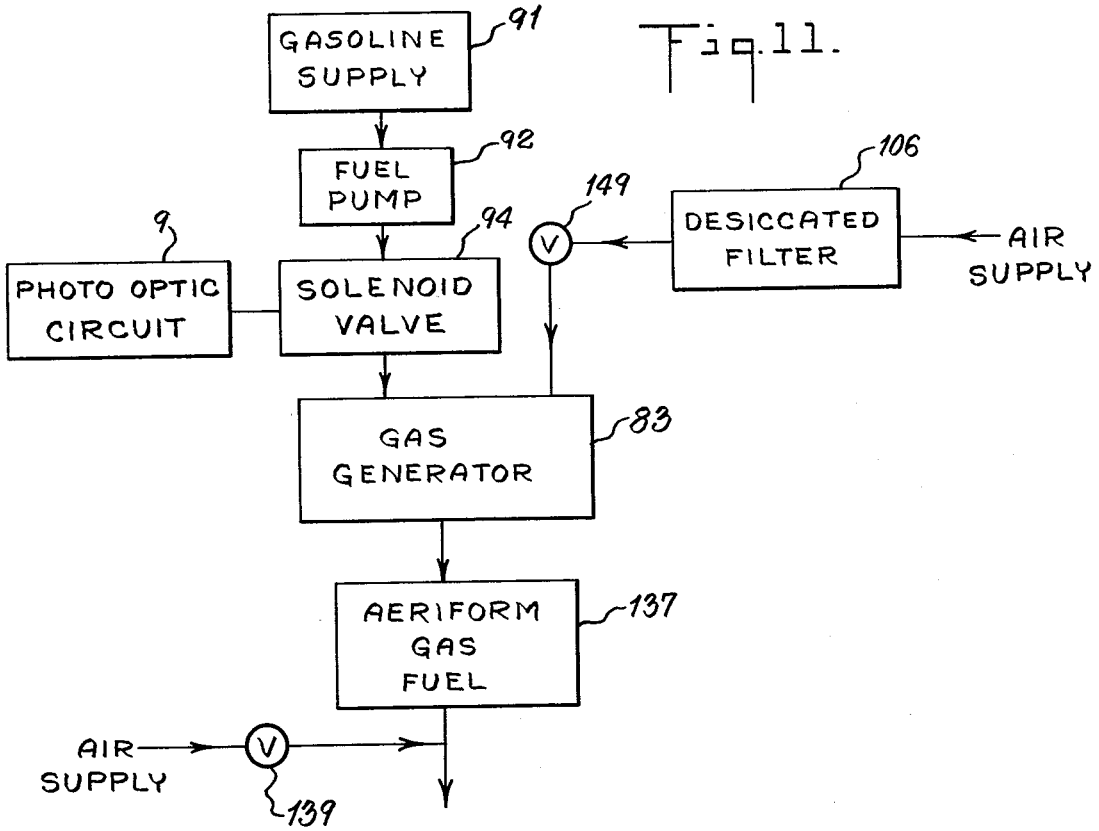
FIG. 11 is a block diagram of the unit.
Figure 12:
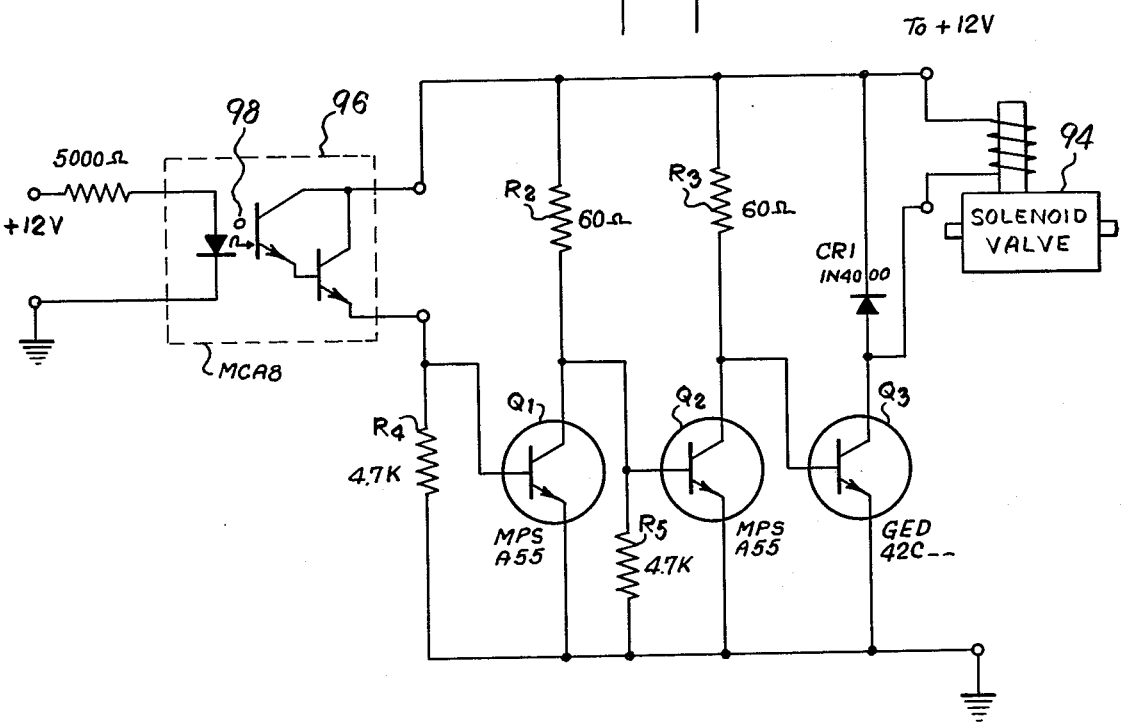
FIG. 12 is an electrical schematic diagram of the solenoid valve and photo optic switch.

FIG. 11 shows a block plan of the invention and, since it is rather clear and evident needs no further explanation; and FIG. 12, which illustrates a schematic electrically for the photo-optic switch 96 operation of the solenoid valve 94, is conventional and requires no detailed explanation thereof.

In operation, liquid gasoline 90 flows from the gasoline tank 91 via fuel pump 92, tube 93, solenoid valve 94 under control of the photo optic switch 96, and tube 97 to the receptacle 84 until the gasoline reaches a predetermined level in the reservoir 89 of about 50% of the total volume of the receptacle 84.

This level is maintained by action of the hollow ball float 99 as its rod 98 rises and falls to deactivate and activate, respectively, the photo optic switch 96 which in turn controls flow of the gasoline through the solenoid valve 94. The same level of liquid gasoline 90 obtains in the evaporator 111 and vaporizing cell 112. Atmospheric air is introduced into the filter 106, where it is demoisturized by a desiccant, silica jell, contained therein and the demoisturized air is then passed via passageways 155 and 159, hose 161, tubular arrangement 107, passageway 108, and opening 109 into the evaporator 111, where the demoisturized air is jetted through the slits 117 into the vaporizing cell 112 and thence through the disc 119 to expand the gasoline into a vapor 120, the liquid portion of the gasoline dropping to the reservoir 89, after which the expanded gasoline vapor 120 is drawn through the opening 121, disc 122 and thence through the activated charcoal 126. While passing through the charcoal 126, a stabilizing reaction occurs to produce an aeriform gas 137 that is drawn through the sheet 128, screen 129 and ring 131 into the tube 138 on its way to the intake manifold of the engine. At the intake manifold the aeriform gas is mingled with the normally filtered atmospheric air drawn past the butterfly valve 139 under joint control of the high volume control arm 144 and low volume control arm 149. It is to be noted that the aeriform gas 137 retains its stabilized identity and does not lose such identity during its mingling with the normally filtered atmospheric air. Also, it is to be noted that for proper operation of the vehicular engine the air to gas mixture be controlled automatically with a range from 14 to 1(rich) to 22 to 1 (optimal). It is known that when the demand for additional power is required, a richer mixture must be introduced instantaneously. This is accomplished by a damper plate (not shown) which is controlled by a spring (not shown) and activated by the negative pressure or intake cycle of the engine. This occurs, when the foot throttle (not shown) is depressed, thereby causing a momentary drop in vacuum pressure and in turn reducing the secondary intake opening to close off enough to enrich the mixture. The combination of volume control arms 144 and 149 shut down the secondary air intake when starting the engine. This is necessary to maintain a rich mixture for allowing the engine to start while in a cold condition.

From the foregoing description it will be seen that the second embodiment of the present invention provides a substantial increase in efficiency of the use of gasoline in the operation of internal combustion engines. This is substantial particularly in view of the prevailing high cost of gasoline.

As various changes may be made in the form, construction and arrangement of the parts herein, without departing from the spirit and scope of the invention and without sacrificing any of its advantages, it is to be understood that all matters are to be interpreted as illustrative and not in any limiting sense.

What is claimed is:

1. A device for gasifying liquid gasoline comprising, in combination, a substantially closed container, a filter, a desiccant in said filter for demoisturizing incoming air, means attached to the container for supporting the filter, a reservoir of liquid gasoline in said container, means for maintaining a fluid level of said liquid gasoline at about 50% of the total volume of the container, means for jetting the demoisturized air through the liquid gasoline in said reservoir to create an expanded volatile fluid above the reservoir, the expanded volatile fluid including a gas and liquid gasoline, means for breaking down the gas into finer gas particles, and means for stabilizing the gas particles to produce an aeriform gas for use in internal combustion engines, wherein said means for jetting the demoisturized air through the liquid gasoline include tubular means connected to said filter for supplying said demoisturized air, a vaporizing cell disposed in said reservoir and an evaporator disposed in said vaporizing cell, said evaporator including a hollow member with an open base seated on said container and connected to the tubular means for supplying the demoisturized air, said evaporator having a closed top and a wall having upwardly inclined slits for jetting the demoisturized air into the vaporizing cell for production of the expanded volatile fluid, said vaporizing cell including a second hollow member enclosing said evaporator with an open base seated on said container and having an opening in a side wall thereof for entrance of the liquid gasoline therein, and said means for breaking down the gas into finer particles including a solid porous top cover of about 120 microns forming the top of said second hollow member, and wherein said stabilizing means include an open ended cylinder formed within said container, a solid porous top cover of about 90 microns for said cylinder, activated charcoal within said cylinder and screening means at the bottom of said cylinder, whereby the gas particles pass through the porous top cover, enter the cylinder, pass through the activated charcoal and leave the cylinder through the screening means.

2. The device of claim 1, wherein said means for maintaining said fluid level are electromechanical means.

3. The device of claim 2, wherein said electromechanical means comprise an electrical solenoid valve and photo optic switch.

4. The device of claim 3, wherein the activated charcoal includes charcoal granules treated with Cupric Chloride.

5. The device of claim 3, wherein the activated charcoal includes charcoal granules treated with Nickel Chloride.

6. The device of claim 3, including means for automatically mingling the aeriform gas emitted from the activated charcoal cylinder with atmospheric air in a manifold of the engine.

7. The device of claim 6, wherein said automatic mingling means include a low volume control arm pivotally mounted on said filter supporting means for regulating amount of demoisturized air entering the evaporator, a high volume control arm pivotally mounted on said intake air tube for regulating the amount of atmospheric air entering said manifold, link means pivotally interconnecting said low volume and high volume air control arms, and second link means pivotally connected to said low volume air control arm responsive to movement of a foot throttle accelerator of the engine.

* * * * *